US006558218B1

(12) United States Patent
Hansen

(10) Patent No.: US 6,558,218 B1
(45) Date of Patent: May 6, 2003

(54) OVERBOARD RESCUE SYSTEM

(75) Inventor: Eric C. Hansen, Norfolk, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/083,520

(22) Filed: Feb. 27, 2002

(51) Int. Cl.[7] ..... B63C 9/00
(52) U.S. Cl. ..... 441/80; 411/35
(58) Field of Search ..... 441/1, 35, 39, 441/40, 80, 83, 82; 114/144 R

(56) References Cited

U.S. PATENT DOCUMENTS 3,026,545 A * 3/1962 Brainard, II ..... 114/144 A
3,268,925 A 8/1966 Serra
3,883,913 A 5/1975 Givens
4,498,879 A 2/1985 Burr
4,639,229 A 1/1987 Wright et al.
5,427,557 A * 6/1995 Lunden, Sr. ..... 441/82
5,597,335 A 1/1997 Woodland
5,710,989 A 1/1998 Flood
5,779,511 A 7/1998 Davidson, Jr.
5,807,153 A * 9/1998 Allen et al. ..... 441/82

* cited by examiner

*Primary Examiner*—Stephen Avila
(74) *Attorney, Agent, or Firm*—Jacob Shuster

(57) ABSTRACT

A rescue mission is initiated by deployment of an unmanned water surface vehicle some distance from a location at which an overboard person may be in distress. The water surface vehicle is self-propelled under signal responsive or remote manual control for directionally guided travel toward the distress location, at which a raft stored in the vehicle is ejected and inflated so as to floatingly support thereon the person to be rescued. The deployed raft is then moved from the vehicle for delivery to a rescue location.

10 Claims, 2 Drawing Sheets

OVERBOARD RESCUE SYSTEM

STATEMENT OF GOVERNMENT INTEREST

The invention described herein may be manufactured and used by or for the Government of the United States of America for governmental purposes without the payment of any royalties thereon or therefore.

The present invention relates generally to water rescue of overboard personnel in distress.

BACKGROUND OF THE INVENTION

Currently, seawater rescue missions are performed by the U.S. Navy with respect to personnel lost overboard, and by the commercial fishing industry as well as recreational boaters for people lost overboard. Often timing, travel distance and environmental conditions contribute to unsuccessful rescue and high loss of life despite use of rescue gear such as lift boats, buoys, inflatable life-saving rafts, deployment helicopters and other rescue facilities. Recently, assistance in the rescue of overboard sailors in distress equipped with a passive monitor as a source of locational identifying signals has been proposed for signal pick-up and relay at a shipboard rescue location from which available rescue gear may be quickly dispatched by deployment onto the seawater. Generation of such locational and identifying signals is associated with a system disclosed in a publication entitled, "Man Overboard Indicator/Personal Tracking and Monitoring System" listed in the Information Disclosure Statement submitted herewith. However, in view of rescue delay problems associated with deployment and use of available rescue gear, it is an important object of the present invention to provide for an improved rescue mission that is more rapid and effective, involving less costly use of certain available rescue gear including the aforesaid tracking and monitoring system as a source of the locational and identifying signals from the overboard person in distress.

SUMMARY OF THE INVENTION

In accordance with the present invention a rescue mission for overboard personnel in distress initiated in response to a locational and identifying signal, involves use of a streamlined shaped rescue watercraft, generally known in the art, as a self-powered water surface vehicle deployed some distance from a person in distress. Pursuant to the present invention, such water surface vehicle has a storage container for an inflatable life-saving raft (also generally known in the art) which is transported by the vehicle undergoing self-powered propulsion from its deployment location under directional guidance control of remotely generated signals or sensing signals onboard the vehicle for travel toward the distress location of the overboard person with the life raft stored therein. Upon arrival of such water surface vehicle at the distress location of the overboard person, the life raft is deployed by ejection and inflation so as to floatingly accommodate support of the person to be rescued. Such inflated raft with the rescued person thereon is then moved on the water to a rescue location. Initial deployment of the unmanned water surface vehicle may be effected from a marine vessel or from a rescue helicopter aircraft. Sequential operations involving initial vehicle deployment, travel of the vehicle in different directions by self-powered propulsion under signal applied directional guidance, between its deployment location and the rescue location, as well as deployment of the raft including its ejection from vehicle storage, inflation and rescue delivery, may be effected automatically or by manual remote control by signals from some central location.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
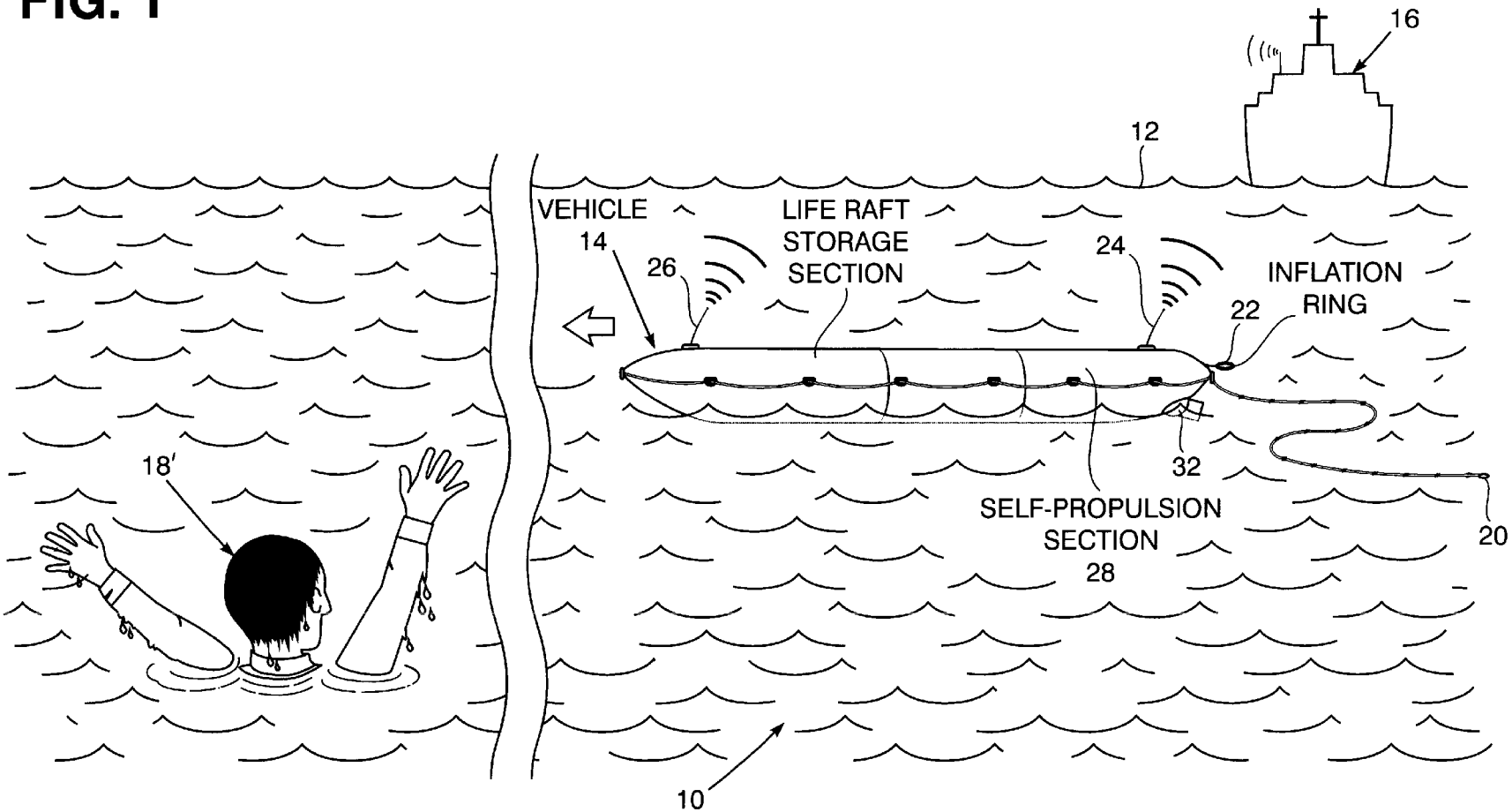
FIG. 1 is a partial schematic side elevation view of seawater disposed rescue gear associated with the present invention.

Referring now to the drawing in detail, FIG. 1 illustrates a body of seawater 10 having a surface 12 on which a streamline shaped vehicle 14 of a generally well known prior art type is floatingly supported during travel to a person 18 in distress at some overboard seawater location. The vehicle 14 is shown connected at several locations on it to a rope 20 which may be grasped by the person 18. A marine vessel 16 is also shown on which a central control station may be located. The vehicle 14 may also have an inflation ring 22 extending from a rear end portion thereof, as well as signal receiving antennae 24 and 26 extending therefrom through which control is exercised over self-powered propulsion means in an aft section 28 of the vehicle 14 during its unmanned propulsion travel. The inflation ring 22 may be utilized by the person 18 to initiate deployment of an inflatable life raft stored in a deflated condition within a forward container section 30 of the vehicle 14. Further, directional guidance control during propulsion travel of the vehicle 14 may be exercised through a rudder steering unit 32 for travel of the vehicle 14 in different directions toward the seawater location of the distressed overboard person 18 and from such location to some rescue location such as the ship 16 to which the deployed and inflated life raft with the person 18 carried thereon may be towed to complete a rescue mission. Alternatively, the deployed life raft with the person 18 thereon may be towed toward a safer and some other accessible rescue location.

Figure 2:
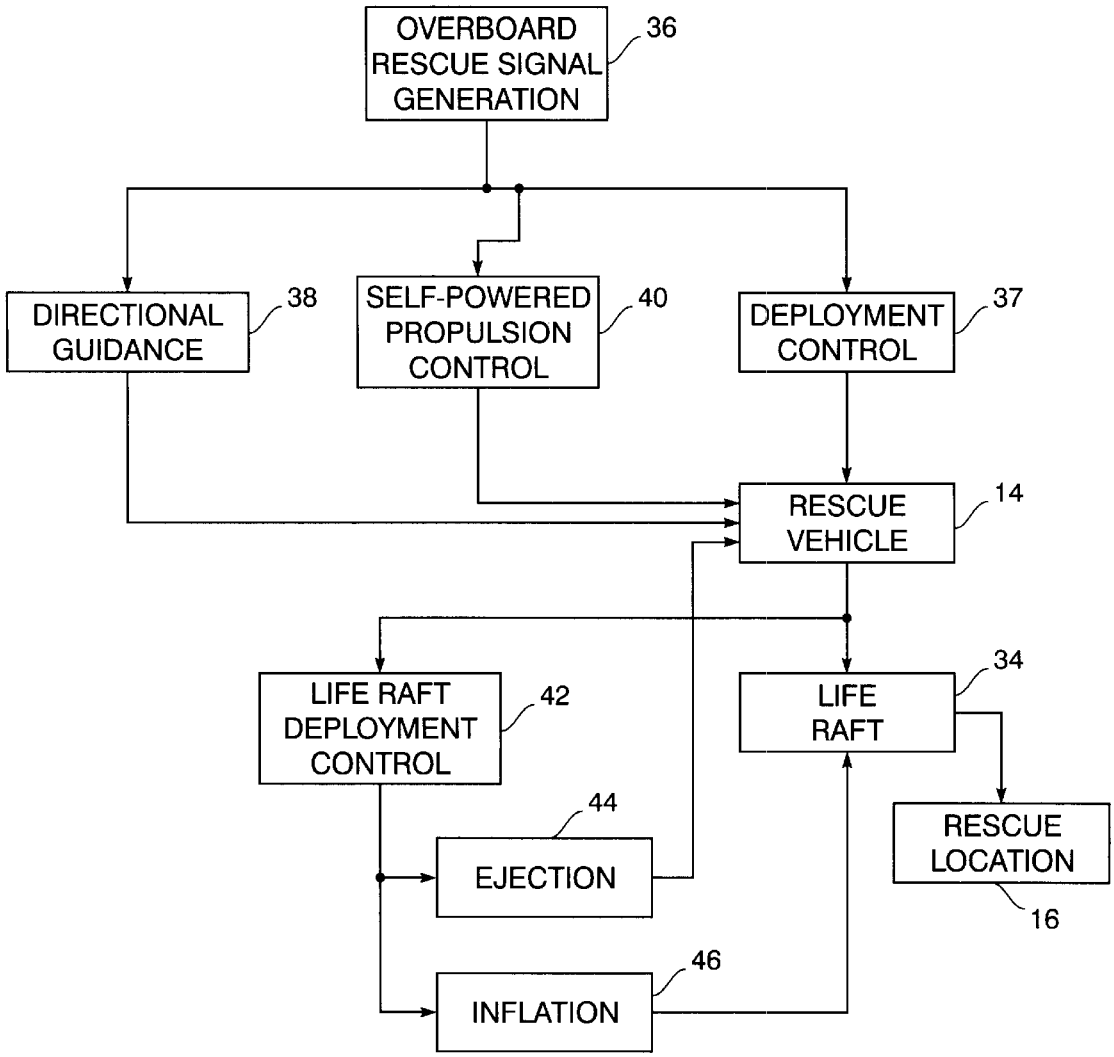
FIG. 2 is a block diagram depicting the rescue mission of the present invention.

The foregoing referred to rescue mission is diagrammed in FIG. 2, involving the rescue vehicle 14 from which the stored life raft 34 is deployed. Generation 36 of the overboard rescue signals hereinbefore referred to effect control 37 for initial deployment of the rescue vehicle 14 followed by directional guidance 38 and propulsion control 40 applied to the deployed vehicle 14 from which deployment control 42 over the life raft 34 is exercised as diagrammed in FIG. 2. Alternatively, life raft deployment may be initiated manually by the person 18 pulling on the inflation ring 22 as aforementioned. Control over life raft deployment also effects ejection 44 of the life raft 34 from storage in the vehicle 14 and inflation 46 so as to floatingly support the person 18 on the inflated raft 34 for rapidly completion of a rescue mission. Such deployed life raft 34 with the person onboard may be towed for delivery to some rescue location, such as the ship 16, or a safe location out of the danger present at the distress location.

Generation 36 of the rescue signals as diagrammed in FIG. 2 may be autonomously effected by means of the tracking and monitoring system hereinbefore referred to, or through control signals produced under manual control at some central location on board the ship 16 for example. Initial deployment of the vehicle 14 onto the seawater surface 12, may be effected either from the ship 16, or from a rescue helicopter aircraft as generally known in the art.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a system for rescuing a person from a distress location in water by delivery to a rescue location utilizing a water surface vehicle deployed into the water, and propelled toward said distress location; a raft stored within the water surface vehicle; means for deployment of the raft from the vehicle upon arrival of the vehicle at said distress location; and means for delivery of the raft after said deployment thereof with the person supported thereon to the rescue location from the distress location.

2. The combination as defined in claim 1, wherein the water surface vehicle is deployed from a marine vessel at said rescue location to which the raft means is directed by said means for delivery.

3. The combination as defined in claim 2, wherein said deployment of the water surface vehicle, deployment of the raft and delivery thereof to the rescue location is sequentially effected in response to generation of rescue signals.

4. The combination as defined in claim 1, wherein the water surface vehicle is deployed from a rescue aircraft.

5. The combination as defined in claim 4, wherein said deployment of the water surface vehicle, deployment of the raft and delivery thereof to the rescue location is sequentially effected in response to generation of rescue signals.

6. A method for rescuing a person from a distress location in water by delivery to a rescue location utilizing a water surface vehicle deployed into the water, comprising the steps of: storing an inflatable raft within the vehicle deployed some distance from the distress location; directionally guiding propulsion of the deployed vehicle with the raft stored therein toward the distress location of the person; deploying the raft from the vehicle at said distress location; and delivering the deployed raft with the person thereon from the distress location to the rescue location.

7. The method as defined in claim 6, wherein said step of deploying the raft includes inflation thereof from a deflated condition while stored in the water surface vehicle.

8. The method as defined in claim 7, wherein the water surface vehicle is deployed from a marine vessel at the rescue location.

9. The method as defined in claim 6, wherein the water surface vehicle is deployed from a marine vessel at the rescue location.

10. The method as defined in claim 6, wherein the water surface vehicle is deployed from an aircraft.

* * * * *